US006598909B2

(12) United States Patent
Lu

(10) Patent No.: US 6,598,909 B2
(45) Date of Patent: Jul. 29, 2003

(54) ELECTRIC DOOR LOCK

(75) Inventor: Chao-Jung Lu, Taipei (TW)

(73) Assignee: EZ Trend Technology Co., Ltd., Chia-Yi (TW)

( * ) Notice: Subject to any disclaimer, the term of this patent is extended or adjusted under 35 U.S.C. 154(b) by 0 days.

(21) Appl. No.: 10/159,104

(22) Filed: May 29, 2002

(65) Prior Publication Data

US 2003/0071471 A1 Apr. 17, 2003

Related U.S. Application Data

(63) Continuation-in-part of application No. 09/977,892, filed on Oct. 15, 2001, now Pat. No. 6,471,257.

(51) Int. Cl.[7] ..... E05C 1/06
(52) U.S. Cl. ..... 292/144; 292/252; 70/280
(58) Field of Search ..... 292/144, 252, 292/142, DIG. 27; 70/275, 280

(56) References Cited

U.S. PATENT DOCUMENTS 4,438,962 A * 3/1984 Soloviff ..... 292/144
4,820,330 A * 4/1989 Lin ..... 70/277
4,995,248 A * 2/1991 Lin ..... 70/107
6,012,310 A * 1/2000 Hsiao ..... 70/278.2

FOREIGN PATENT DOCUMENTS

EP 1 030 011 A1 * 8/2000 ..... E05B/47/06

* cited by examiner

*Primary Examiner*—Gary Estremsky
(74) *Attorney, Agent, or Firm*—Darby & Darby

(57) ABSTRACT

In an electric door lock, a spindle with a manually operable rotary knob is connected operably to a deadbolt, and has a spindle coupling ring sleeved co-rotatably thereon, and a rotary seat sleeved rotatably thereon. The rotary seat has a clutch portion surrounded by a stationary seat and provided with angularly displaced resilient locking units that normally engage the stationary seat, and is disengaged from the stationary seat to permit operation of the rotary knob to rotate the spindle. An electric driving motor has a transmission shaft coupled to the rotary seat. The locking units are disengaged from the stationary seat and engage the spindle coupling ring when the motor is operated to rotate the rotary seat, thereby resulting in co-rotation of the spindle. The locking units include ball members which move rollingly out of locking grooves in the stationary seat when the rotary seat is rotated.

9 Claims, 6 Drawing Sheets

ELECTRIC DOOR LOCK

CROSS-REFERENCE TO RELATED APPLICATION

This application is a continuation-in-part (CIP) of U.S. patent application Ser. No. 09/977,892, filed on Oct. 15, 2001 now U.S. Pat. No. 6,471,257, the entire disclosure of which is incorporated herein by reference.

BACKGROUND OF THE INVENTION

1. Field of the Invention

The present invention relates to an electric door lock, more particularly to an electric door lock which is operable both manually and electrically.

2. Description of the Related Art

Electric door locks are known in the art. A conventional electric door lock generally includes an electric motor with a transmission shaft coupled to a spindle which is connected operably to a latch-bolt. By operating the electric motor, the spindle is rotated to move the latch-bolt between locking and unlocking positions. On the other hand, a conventional manually operable door lock is known to include a lock body having a manual operating portion and a key-operated lock unit which are operable for rotating a spindle, and a latch-bolt connected operably to the spindle. By operating the manual operating portion or by operating the lock unit with the corresponding key, the spindle can be rotated to move the latch-bolt between locking and unlocking positions.

In the aforementioned co-pending U.S. patent application Ser. No. 09/977,892, there is disclosed an electric door lock that is operable electrically and manually so as to provide added convenience to the user. The electric door lock includes a deadbolt mounted in a lock housing and movable between locking and unlocking positions. A manual operating member is mounted on the lock housing, and has a spindle that extends into the lock housing and that is connected operably to the deadbolt, and a manually operable rotary knob that is secured to one end of the spindle and that is disposed externally of the lock housing. A spindle coupling ring is sleeved on the spindle so as to be co-rotatable therewith. The spindle coupling ring has an annular outer peripheral surface formed with a plurality of angularly displaced first locking grooves. A rotary seat has a circular gear plate portion sleeved rotatably on the spindle, and an annular clutch portion connected fixedly and co-axially to the gear plate portion. The clutch portion is disposed around the spindle coupling ring, and has an inner surface confronting the spindle coupling ring, and an outer surface opposite to the inner surface. The clutch portion is formed with a plurality of mounting holes which are aligned respectively with the first locking grooves in the spindle coupling ring. Each of the mounting holes has an open inner hole end formed at the inner surface, and an open outer hole end formed at the outer surface. A stationary seat is disposed within and is secured to the lock housing. The stationary seat has a ring portion which is disposed around the clutch portion and which has an annular inner peripheral surface confronting the clutch portion. The inner peripheral surface is formed with a plurality of angularly displaced second locking grooves. The locking units are mounted respectively in the mounting holes, and each has a locking member with an inner locking portion disposed at the inner hole end of the respective mounting hole, and an outer locking portion disposed at the outer hole end of the respective mounting hole. The locking member is normally disposed in a first position, in which the outer locking portion of the locking member projects radially and outwardly from the outer surface of the clutch portion and engages a respective one of the second locking grooves in the stationary seat for locking the rotary seat to the stationary seat, and in which the inner locking portion of the locking member is retracted into the mounting hole and is disengaged from a respective one of the first locking grooves in the spindle coupling ring for unlocking the rotary seat from the spindle coupling ring. The rotary knob is operable to rotate the spindle for moving the deadbolt between the locking and unlocking positions when the locking members are disposed in the first position. An electric driving motor has a transmission shaft coupled to the gear plate portion of the rotary seat, and is operable to drive rotation of the rotary seat for moving the locking units to a second position, in which the outer locking portion of the locking member of each of the locking units slides past the respective one of the second locking grooves and is disengaged from the respective one of the second locking grooves for unlocking the rotary seat from the stationary seat, and in which the locking member is depressed by the inner peripheral surface of the ring portion of the stationary seat against restoring action thereof so as to enable the inner locking portion of the locking member to project from the inner surface of the clutch portion and engage the respective one of the first locking grooves in the spindle coupling ring for locking the rotary seat to the spindle coupling ring, thereby enabling co-rotation of the spindle for moving the dead bolt between the locking and unlocking positions. An electric switch unit is mounted in the lock housing, and is connected electrically to the electric driving motor. A switch actuator is mounted on the spindle for co-rotation therewith, and projects in a radial direction with respect to the axis of the spindle. The switch actuator is movable with the spindle relative to the electric switch unit, and enables the electric switch unit to control operation of the electric driving motor in a manner that the electric driving motor drives rotation of the spindle by a predetermined angle when the electric driving motor is operated.

The outer locking portion of each locking member has a head portion with a convex outer surface which slides past a tapered wall part in a respective one of the second locking grooves when the rotary seat is rotated for retracting the locking member into the respective mounting hole. It was found that sliding movement of the head portion of the locking member along the tapered wall part is slightly retarded by friction between the convex outer surface and the tapered wall part, thereby adversely affecting smooth movement during electrical operation of the electric door lock.

SUMMARY OF THE INVENTION

The object of the present invention is to provide an electric door lock that is operable both electrically and manually and that can be operated in a relatively smooth manner.

Accordingly, the electric door lock of the present invention includes a lock housing, a deadbolt mounted in the lock housing and movable between locking and unlocking positions, a manual operating member, a spindle coupling ring, a rotary seat, a stationary seat, a plurality of resilient locking units, an electric driving motor, an electric switch unit, and a switch actuator. The manual operating member is mounted on the lock housing, and has a deadbolt operating spindle that extends into the lock housing and that is connected operably to the deadbolt, and a manually operable rotary knob that is secured to one end of the spindle and that is disposed externally of the lock housing. The spindle coupling ring is sleeved on the spindle so as to be co-rotatable therewith. The spindle coupling ring has an annular outer peripheral surface formed with a plurality of first locking grooves. Each of the first locking grooves is displaced angularly from an adjacent one of the first locking grooves by a predetermined angle with respect to an axis of the spindle. The rotary seat has a circular gear plate portion that is sleeved rotatably on the spindle. The gear plate portion has a peripheral edge formed with a set of transmission teeth. The rotary seat further has an annular clutch portion connected fixedly and co-axially to the gear plate portion. The clutch portion is disposed around the spindle coupling ring, and has an inner surface confronting the spindle coupling ring, and an outer surface opposite to the inner surface. The clutch portion is formed with a plurality of mounting holes aligned respectively with the first locking grooves in the spindle coupling ring. Each of the mounting holes has an open inner hole end formed in the inner surface, and an open outer hole end formed in the outer surface. The stationary seat is disposed within and is secured to the lock housing. The stationary seat has a ring portion which is disposed around the clutch portion and which has an annular inner peripheral surface confronting the outer surface of the clutch portion. The inner peripheral surface is formed with a plurality of second locking grooves. Each of the second locking grooves is displaced angularly from an adjacent one of the second locking grooves by the predetermined angle with respect to the axis of the spindle. The locking units are mounted respectively in the mounting holes in the clutch portion. Each of the locking units includes a locking pin, a ball member, and a compression spring. The locking pin has an inner end disposed at the inner hole end of the respective one of the mounting holes, and an outer end opposite to the inner end and disposed proximate to the outer hole end of the respective one of the mounting holes. The ball member is disposed at the outer hole end of the respective one of the mounting holes adjacent to the outer end of the locking pin. The compression spring is disposed within the respective one of the mounting holes, and is sleeved around the locking pin for biasing the locking pin in a radial outward direction. The locking units are normally disposed in a first position, in which the ball members of the locking units project radially and outwardly relative to the outer surface of the clutch portion and engage respectively the second locking grooves in the stationary seat for locking the rotary seat to the stationary seat, and in which the inner ends of the locking pins are retracted into the mounting holes and are disengaged from the first locking grooves in the spindle coupling ring for unlocking the rotary seat from the spindle coupling ring. The rotary knob is operable to rotate the spindle for moving the deadbolt between the locking and unlocking positions when the locking units are disposed in the first position. The electric driving motor has a transmission shaft coupled to the transmission teeth of the rotary seat. The electric driving motor is operable to drive rotation of the rotary seat for moving the locking units to a second position, in which the ball members move rollingly out of the second locking grooves and move along the inner peripheral surface of the stationary seat so as to depress the locking pins in radial directions against restoring action of the compression springs and so as to enable the inner ends of the locking pins to project from the inner surface of the clutch portion and engage respectively the first locking grooves in the spindle coupling ring for locking the rotary seat to the spindle coupling ring, thereby enabling co-rotation of the spindle with the rotary seat for moving the deadbolt between the locking and unlocking positions. The electric switch unit is mounted in the lock housing, and is connected electrically to the electric driving motor. The switch actuator is mounted on the spindle for co-rotation therewith, and projects in a radial direction with respect to the axis of the spindle. The switch actuator is movable with the spindle relative to the electric switch unit, and enables the electric switch unit to control operation of the electric driving motor in a manner that the electric driving motor drives rotation of the spindle by the predetermined angle when the electric driving motor is operated.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
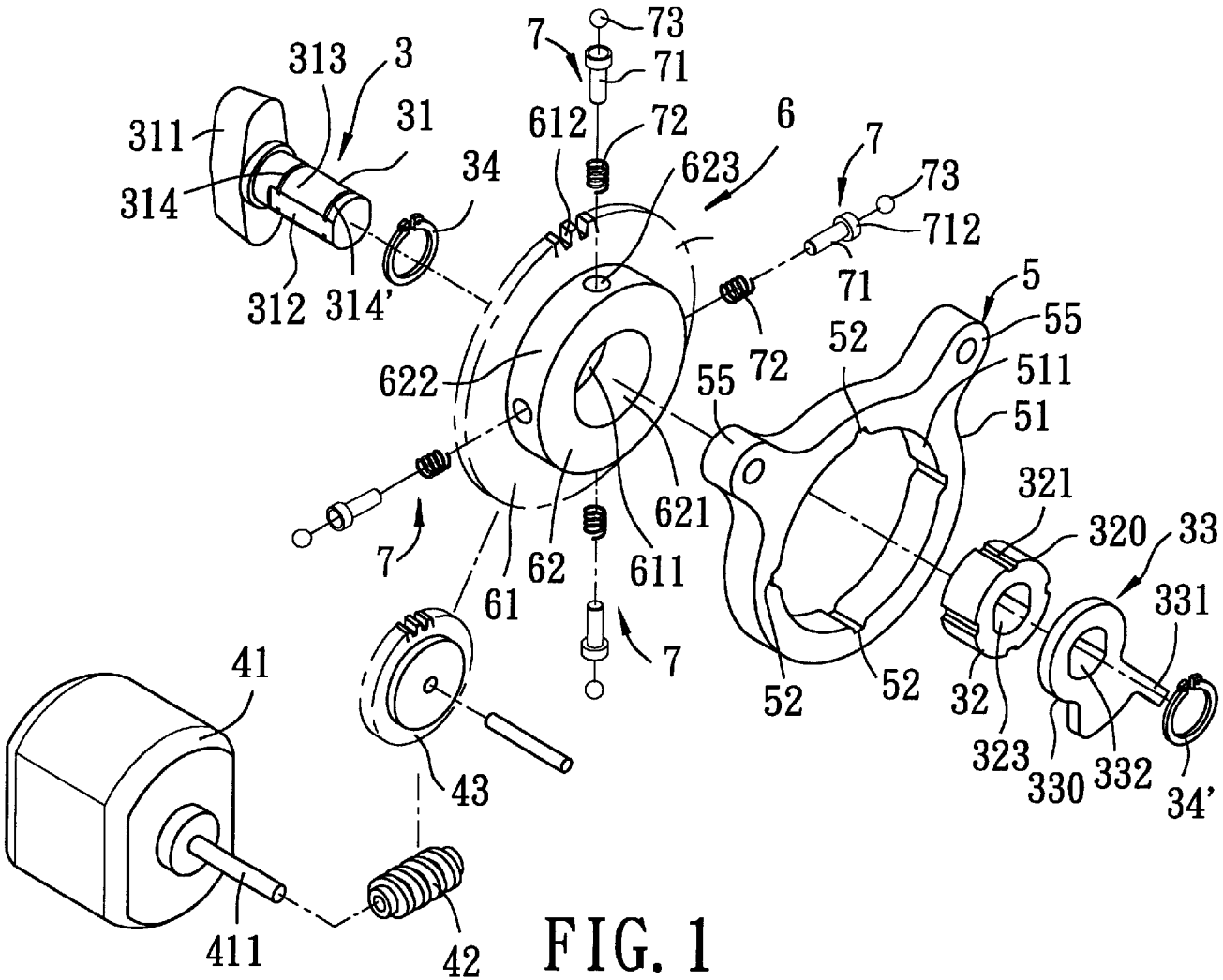
FIG. 1 is an exploded perspective view of a first preferred embodiment of the electric door lock of the present invention, where a lock housing and a deadbolt are removed for the sake of clarity.
Figure 2:
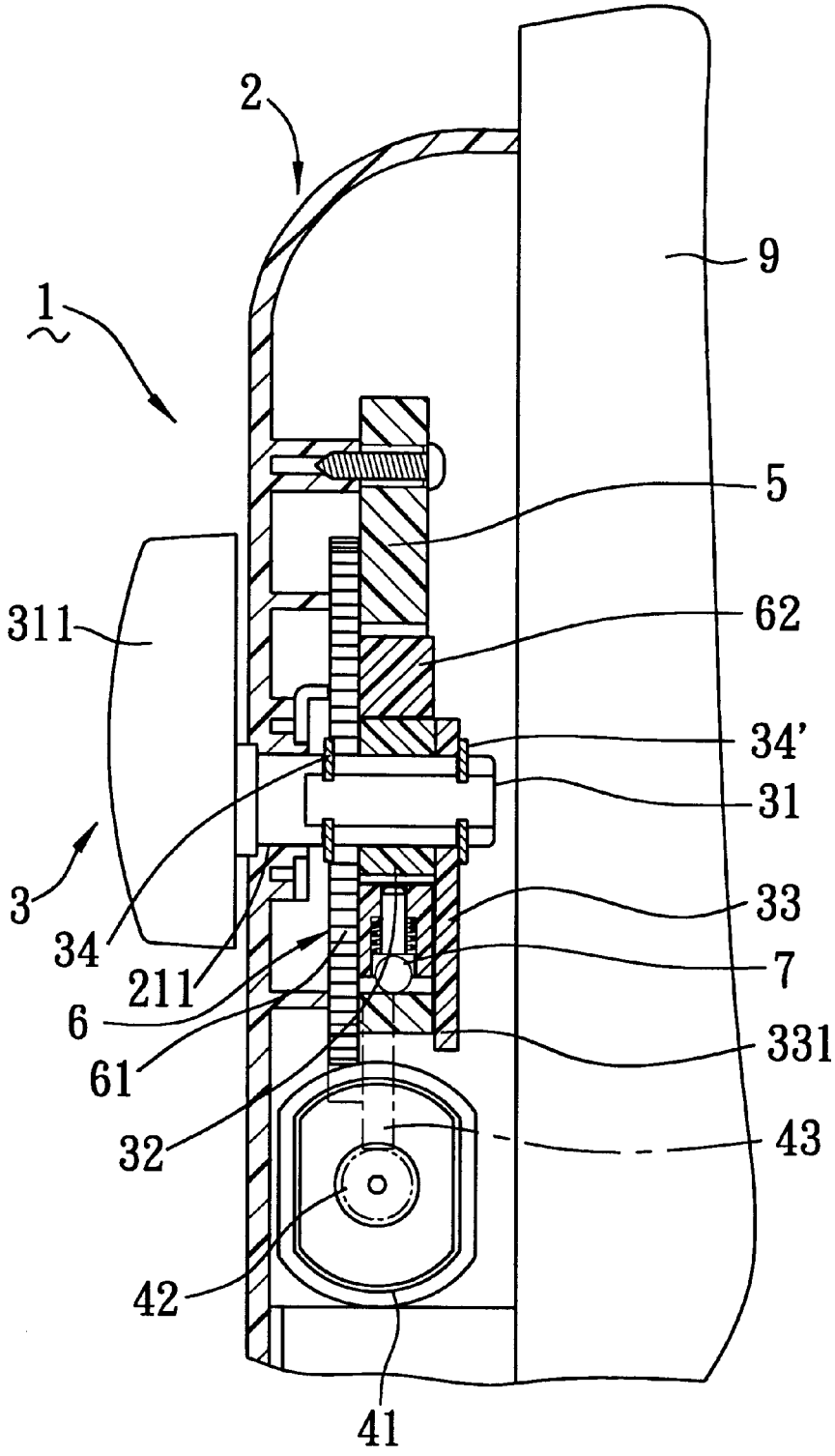
FIG. 2 is a sectional side view of the first preferred embodiment when locking units thereof are disposed in a first position.
Figure 3:
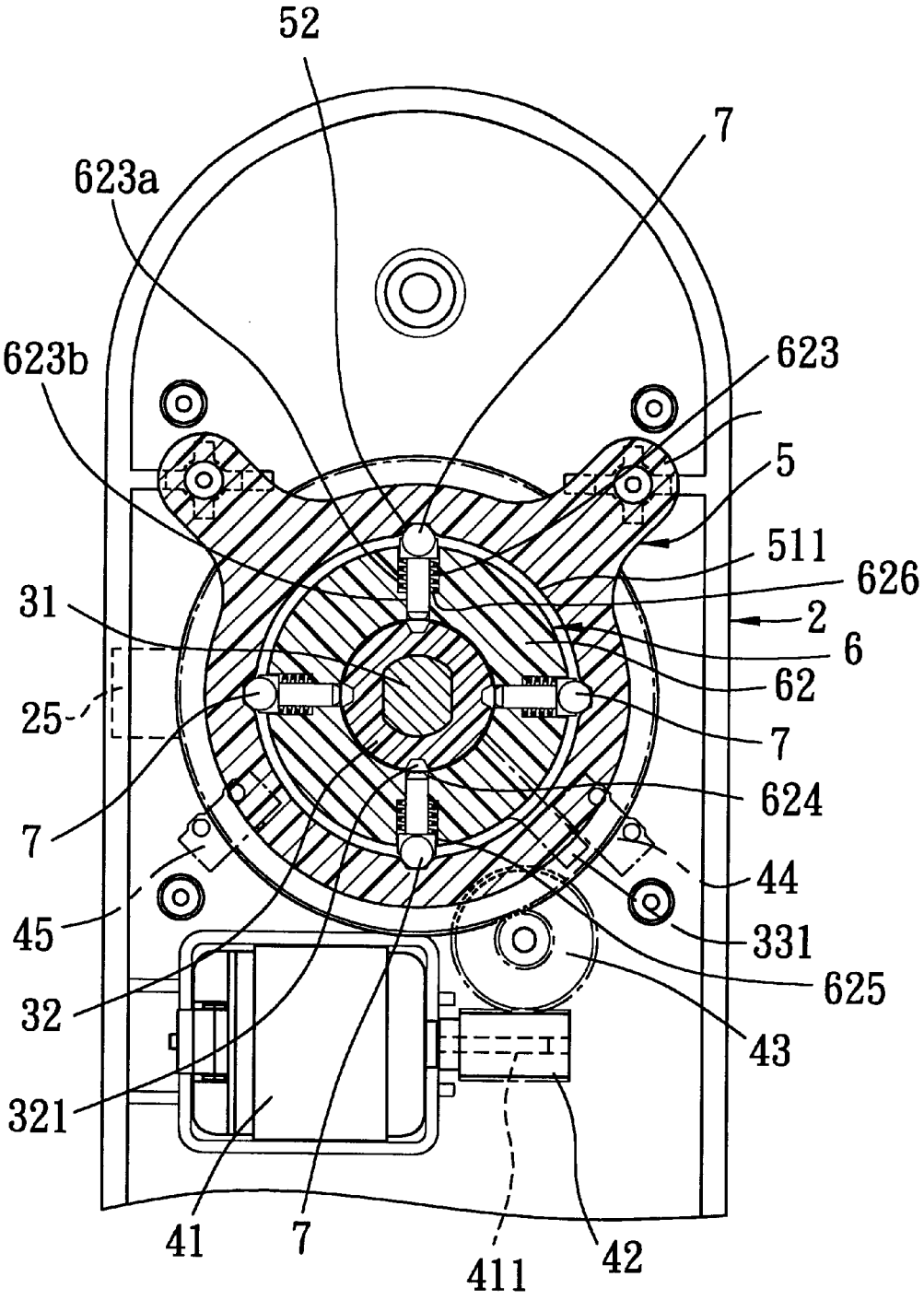
FIG. 3 is an elevational sectional view of the first preferred embodiment when the locking units are disposed in the first position.

Referring to FIGS. 1 to 3, the first preferred embodiment of the electric door lock 1 of the present invention is adapted to be installed on a door panel 9, and is shown to include a lock housing 2, a deadbolt 25, a manual operating member 3, a spindle coupling ring 32, a rotary seat 6, a stationary seat 5, a plurality of resilient locking units 7, an electric driving motor 41, an electric switch unit including a locking switch member 45 and an unlocking switch member 44, and a switch actuator 33.

The lock housing 2 is adapted to be mounted on the door panel 9, and has the deadbolt 25 mounted therein. The deadbolt 25 is operable to move between a locking position, in which the deadbolt 25 projects from a peripheral edge wall (not shown) of the door panel 9, and an unlocking position, in which the deadbolt 25 is retracted into the peripheral edge wall of the door panel 9. The manual operating member 3 is mounted on the lock housing 2, and has a deadbolt operating spindle 31 which extends through a spindle hole 211 formed in the lock housing 2 and into an interior of the lock housing 2, and which is connected operably to the deadbolt 25 in a known manner for moving the deadbolt 25 between the locking and unlocking positions. The spindle 31 has two diametrically opposite flat surfaces 312, and two diametrically opposite curved surfaces 313 interconnecting the flat surfaces 312 so as to provide the spindle 31 with a symmetrical and non-circular cross-section. The curved surfaces 313 are formed with first and second retaining grooves 314, 314' which are displaced from each other in the longitudinal direction of the spindle 31 for engaging first and second retaining rings 34, 34', respectively. The manual operating member 3 further includes a manually operable rotary knob 311 secured to one end of the spindle 31 and disposed externally of the lock housing 2.

The spindle coupling ring 32 defines a non-circular spindle coupling hole 323 conforming with the cross-section of the spindle 31, and is sleeved on the spindle 31 for co-rotation therewith. The spindle coupling ring 32 has an annular outer peripheral surface 320 formed with four angularly displaced first locking grooves 321, each of which extends axially between front and rear end faces of the spindle coupling ring 32. Each of the first locking grooves 321 is displaced angularly from an adjacent one of the first locking grooves 321 by a predetermined angle, such as about 90 degrees in the present embodiment, with respect to an axis of the spindle 31.

The switch actuator 33 has a ring portion 330 that similarly defines a spindle coupling hole 332 conforming with the cross-section of the spindle 31, and that is sleeved on the spindle 31 adjacent to the spindle coupling ring 32 for co-rotation with the spindle 31. The switch actuator 33 is formed with an actuating projection 331 which projects from the ring portion 330 in a radial outward direction with respect to the axis of the spindle 31.

The rotary seat 6 is sleeved rotatably on the spindle 31, and has a circular gear plate portion 61 formed with a spindle hole 611 for extension of the spindle 31 therethrough, and an annular clutch portion 62 connected fixedly and co-axially to the gear plate portion 61. The gear plate portion 61 has an annular part projecting relative to the clutch portion 62 in radial directions, and has a peripheral edge formed with a set of transmission teeth 612. The clutch portion 62 is disposed around the spindle coupling ring 32, and has an annular inner surface 621 confronting the spindle coupling ring 32 and an annular outer surface 622 opposite to the inner surface 621. The clutch portion 62 is formed with four mounting holes 623, each of which extends in a radial direction through the clutch portion 62, and each of which has an open inner hole end 624 formed in the inner surface 621 of the clutch portion 62, and an open outer hole end 625 formed in the outer surface 622 of the clutch portion 62. Each of the mounting holes 623 has a stepped hole defining wall that defines a wider hole section 623*a* adjacent to the outer hole end 625, a narrower hole section 623*b* adjacent to the inner hole end 624, and an annular shoulder 626 formed between the wider and narrower hole sections 623*a*, 623*b*. Each of the mounting holes 623 is displaced from an adjacent one of the mounting holes 623 by the predetermined angle, i.e., about 90 degrees in the present embodiment. The mounting holes 623 are aligned respectively with the first locking grooves 321 in the spindle coupling ring 32.

Figure 4:
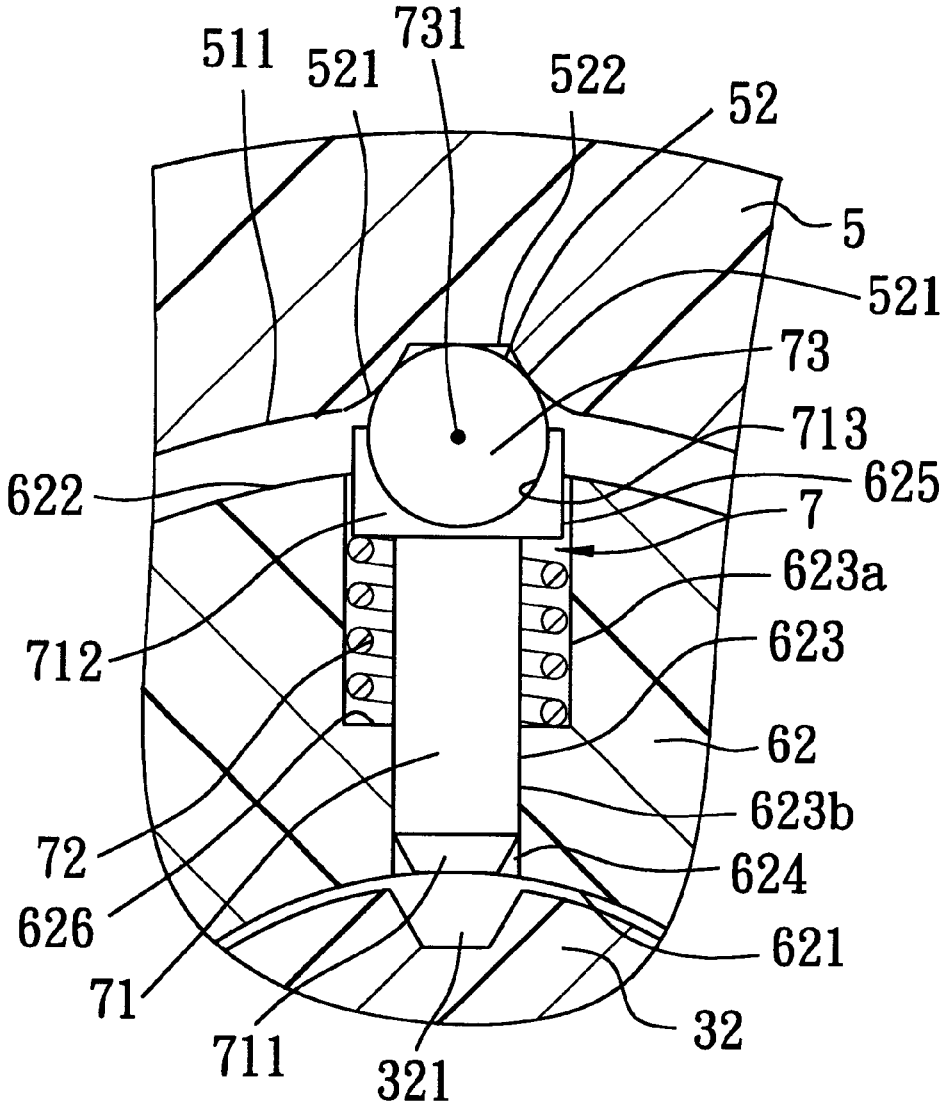
FIG. 4 is an enlarged fragmentary view of FIG. 3.

The stationary seat 5 is disposed within the lock housing 2, and includes a ring portion 51 and two fastening lobes 55 projecting from the ring portion 51. The stationary seat 5 is secured to the lock housing 2 by means of screw fasteners that extend through the fastening lobes 55. The ring portion 51 is disposed around the clutch portion 62 of the rotary seat 6, and has an annular inner peripheral surface 511 confronting the outer surface 622 of the clutch portion 62. The inner peripheral surface 511 is formed with four angularly displaced second locking grooves 522, each of which extends parallel to the axis of the spindle 31 and between front and rear end faces of the stationary seat 5. Each of the second locking grooves 52 is displaced angularly from an adjacent one of the second locking grooves 52 by the predetermined angle, i.e., about 90 degrees in the present embodiment, with respect to the axis of the spindle 31. With further reference to FIG. 4, each of the second locking grooves 52 is defined by a groove-defining wall that has two side wall parts 521 opposing each other, and a bottom wall part 522 interconnecting the side wall parts 521. Each of the side wall parts 521 has a convex surface.

Each of the locking units 7 is mounted in a respective one of the mounting holes 623 in the clutch portion 62, and includes a locking pin 71, a ball member 73, and a coiled compression spring 72. The locking pin 71 has an inner end 711 disposed at the inner hole end 624 of the respective mounting hole 623, and an outer end formed as a head portion 712 and disposed at the outer hole end 625 of the respective mounting hole 623. The head portion 712 is formed with a hemispherical ball recess 713 that opens in a radial outward direction. The ball member 73, with a ball center 731, is disposed at the outer hole end 625 of the respective mounting hole 623, and is disposed adjacent to the head portion 712 of the locking pin 71 so as to be partly and rotatably received in the ball recess 713. Preferably, a hemispherical part of the ball member 731 is received in the ball recess 713. The compression spring 72 is sleeved on the locking pin 71, and is disposed between the shoulder 626 in the respective mounting hole 623 and the head portion 712 of the locking pin 71 for biasing the locking pin 71 in a radial outward direction along the respective mounting hole 623.

The locking and unlocking switch members 45, 44, each of which is in the form of an optoelectric switch in the present embodiment, are mounted on the lock housing 2 adjacent to the switch actuator 33. In the present embodiment, the locking and unlocking switch members 45, 44 are spaced apart by an angle of about 90 degrees with respect to the axis of the spindle 31.

The electric driving motor 41 is mounted in the lock housing 2, and is connected electrically to the locking and unlocking switch members 45, 44. The electric driving motor 41 has a transmission shaft 411. A worm gear 42 is secured to the transmission shaft 411 such that the worm gear 42 is rotatable about an axis of the transmission shaft 411 during operation of the electric driving motor 41. A transmission gear 43 is mounted rotatably in the lock housing 2, and is disposed between the worm gear 42 and the rotary seat 6. The transmission gear 43 engages the worm gear 42 and the transmission teeth 612 on the gear plate portion 61 of the rotary seat 6, thereby transmitting rotation of the worm gear 42 to the rotary seat 6.

Due to the biasing action of the compression springs 72, the locking units 7 are normally disposed in a first position, in which the ball members 73 of the locking units 7 project radially and outwardly relative to the outer surface 622 of the clutch portion 62, and engage respectively the second locking grooves 52 in the stationary seat 5 for locking the rotary seat 6 to the stationary seat 5, and in which the inner ends 711 of the locking pins 71 are retracted respectively into the mounting holes 623 and are disengaged from the first locking grooves 321 in the spindle coupling ring 32 for unlocking the rotary seat 6 from the spindle coupling ring 32. That is to say, the rotary seat 6 is normally locked to the stationary seat 5, and is normally unlocked from the spindle coupling ring 32. As such, the spindle coupling ring 32, under this state, is rotatable with the spindle 31 independently of the rotary seat 6.

When the electric door lock 1 of the present embodiment is in an unlocking state, the actuating projection 331 of the switch actuator 33 is disposed proximate to the unlocking switch member 41, as shown in FIG. 3. When it is desired to operate the electric door lock 1 manually, the rotary knob 311 is rotated manually to rotate the spindle 31. Since the locking units 7 are normally disposed in the first position where they are disengaged from the spindle coupling ring 32, rotation of the spindle 31 is not hindered by the rotary seat 6, thereby facilitating operation of the manual operating member 3. At this time, the locking and unlocking switch members 45, 44 are not actuated since the electric driving motor 41 is not operated.

Figure 5:
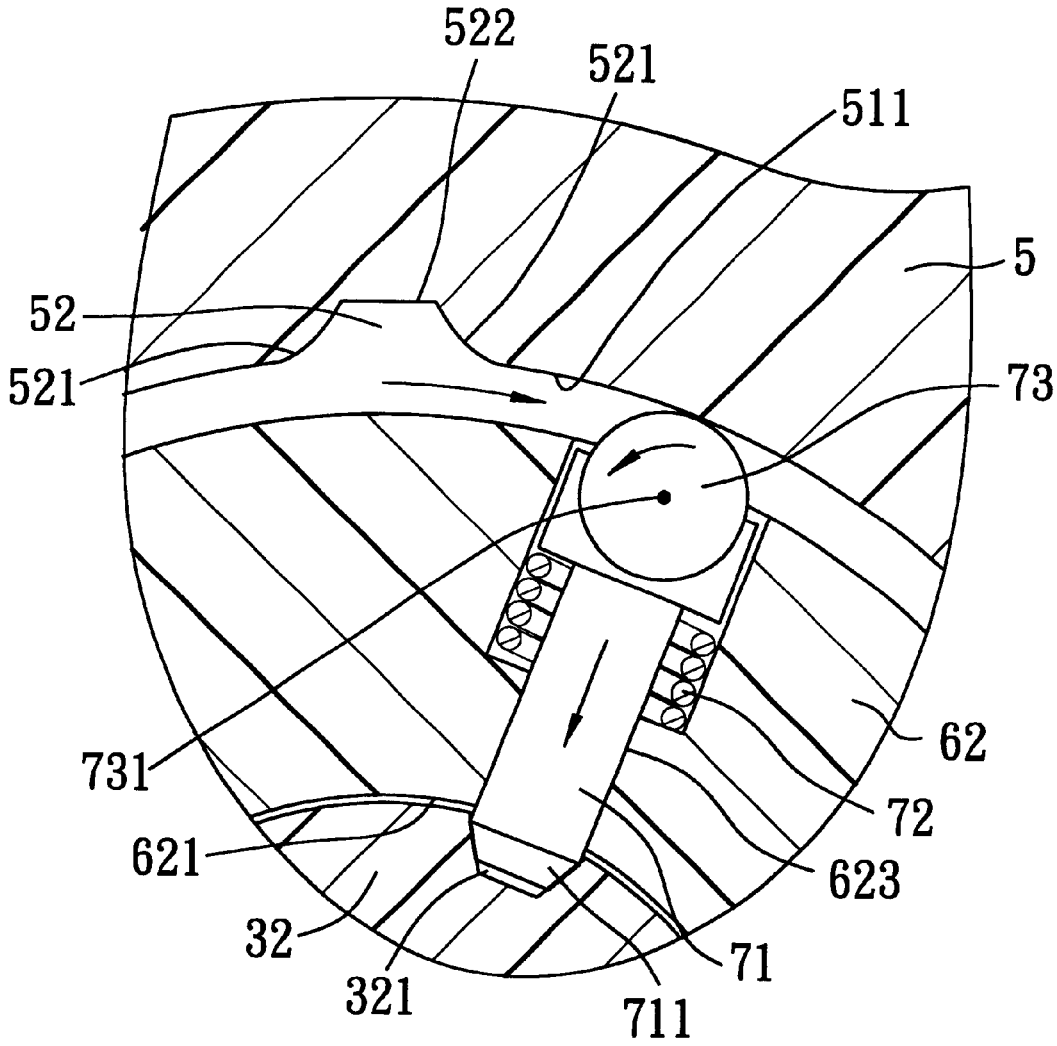
FIG. 5 is an enlarged fragmentary view of the first preferred embodiment, illustrating one of the locking units when moved to a second position.

Referring to FIGS. 1, 3 and 5, to operate the electric door lock 1 electrically for locking the same, the electric driving motor 41 is operated, such as by a remote controller (not shown), to enable rotation of the worm gear 42 and the transmission gear 43, which, in turn, rotates the gear plate portion 61 as well as the clutch portion 62 of the rotary seat 6. As shown in FIG. 5, each of the second locking grooves 52 has a depth smaller than the radius of the ball members 73. When the clutch portion 62 is rotated, each ball member 73 moves rollingly past the convex surface on one of the side wall parts 521 of a corresponding one of the second locking grooves 52 in the stationary seat 5 and moves out of the corresponding second locking groove 52 for disengaging from the second locking grooves 52 and for unlocking the rotary seat 6 from the stationary seat 5. The locking units 7 are thus disposed at a second position. At this time, the ball members 73 move along the inner peripheral surface 511 of the stationary seat 5 and depress the locking pins 71 in radial directions against the restoring action of the compression springs 72 so as to enable the inner ends 711 of the locking pins 71 to project from the inner surface 621 of the clutch portion 62 and engage respectively the first locking grooves 321 in the spindle coupling ring 32 for locking the rotary seat 6 to the spindle coupling ring 32, thereby enabling co-rotation of the spindle 31 with the rotary seat 6 for moving the deadbolt 25 (see FIG. 3) between the locking and unlocking positions, and thereby causing corresponding movement of the switch actuator 33 with the spindle 31. When the spindle 31 is rotated by the predetermined angle, the actuating projection 331 of the switch actuator 33 is moved adjacent to the locking switch member 45. Upon sensing the actuating projection 331, the locking switch member 45 is actuated to provide an electric signal to the electric driving motor 41 for deactivating the same, thereby positioning the deadbolt 25 in the locking position. Likewise, to move the deadbolt 25 from the locking position to the unlocking position, the electric driving motor 41 is operated to rotate the transmission shaft 411 and the worm gear 42 in an opposite direction. The unlocking switch member 44 operates in a manner similar to that of the locking switch member 45 for deactivating the electric driving motor 41.

Figure 6:
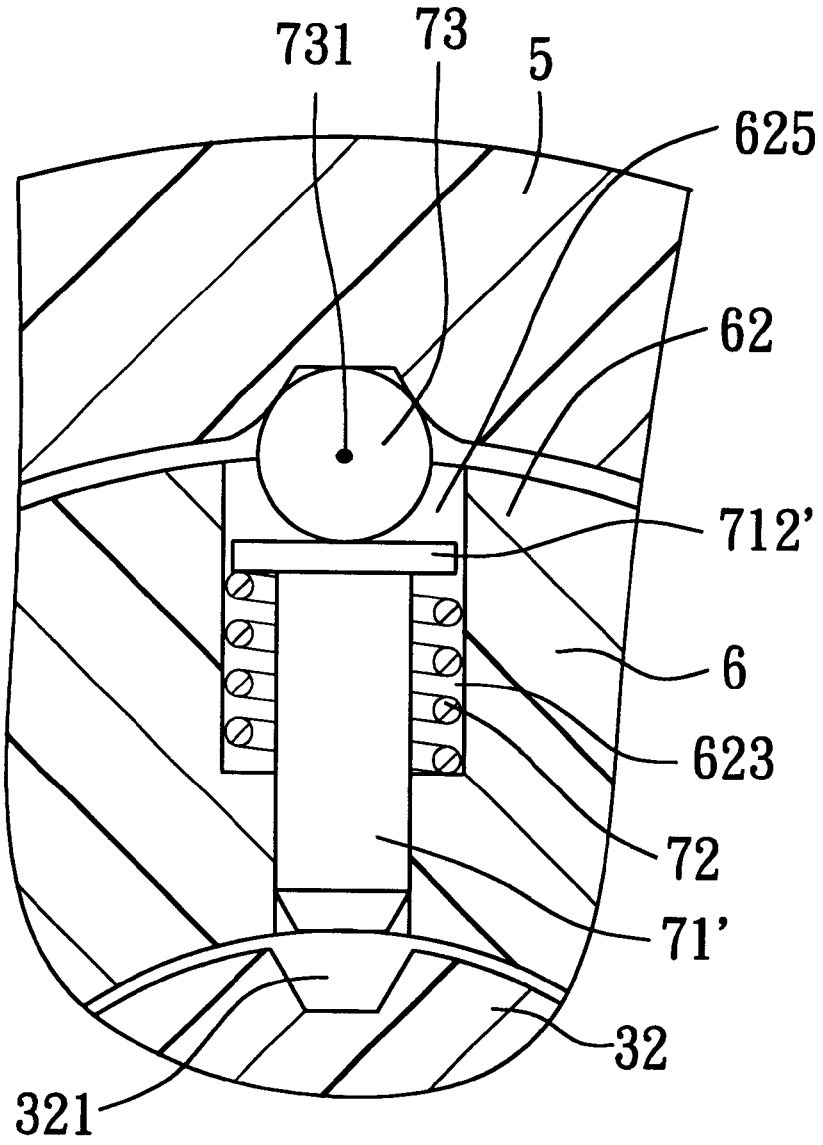
FIG. 6 is an enlarged fragmentary view of a second preferred embodiment of the electric door lock of the present invention.

Referring to FIG. 6, in the second preferred embodiment of the electric door lock of the present invention, the head portion 712' of the locking pin 71' of each of the locking units is not formed with a ball recess, and is in the form of a flat plate which abuts against the ball member 73 of the respective locking unit. The ball member 73 has a hemispherical part extending into the outer hole end 625 of the corresponding mounting hole 623, and abuts against the flat plate on the outer end of the locking pin 71' when the locking unit 7 is disposed in the first position. The electric door lock of the present embodiment is operable manually and electrically in a manner similar to that of the previous embodiment.

It has thus been shown that, in the electric door lock 1 of the present invention, the rotary seat 6 is normally unlocked from the spindle coupling ring 32. As such, rotation of the spindle 31 is not hindered by any component of the electric door lock 1, thereby facilitating manual operation of the rotary knob 311. Moreover, since the ball members 73 move rollingly out of the second locking grooves 52 for disengaging the rotary seat 6 from the stationary seat 5 when the rotary seat 6 is rotated during operation of the electric driving motor 41, smooth movement can be ensured when the electric door lock 1 is operated electrically.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. An electric door lock comprising:

a lock housing;

a deadbolt mounted in said lock housing and movable between locking and unlocking positions;

a manual operating member mounted on said lock housing and having a deadbolt operating spindle that extends into said lock housing and that is connected operably to said deadbolt, and a manually operable rotary knob that is secured to one end of said spindle and that is disposed externally of said lock housing;

a spindle coupling ring sleeved on said spindle so as to be co-rotatable therewith, said spindle coupling ring having an annular outer peripheral surface formed with a plurality of first locking grooves, each of said first locking grooves being displaced angularly from an adjacent one of said first locking grooves by a predetermined angle with respect to an axis of said spindle;

a rotary seat having a circular gear plate portion that is sleeved rotatably on said spindle, said gear plate portion having a peripheral edge formed with a set of transmission teeth, said rotary seat further having an annular clutch portion connected fixedly and co-axially to said gear plate portion, said clutch portion being disposed around said spindle coupling ring, and having an inner surface confronting said spindle coupling ring, and an outer surface opposite to said inner surface, said clutch portion being formed with a plurality of mounting holes aligned respectively with said first locking grooves in said spindle coupling ring, each of said mounting holes having an open inner hole end formed in said inner surface and an open outer hole end formed in said outer surface;

a stationary seat disposed within and secured to said lock housing, said stationary seat having a ring portion which is disposed around said clutch portion and which has an annular inner peripheral surface confronting said outer surface of said clutch portion, said inner peripheral surface being formed with a plurality of second locking grooves, each of said second locking grooves being displaced angularly from an adjacent one of said second locking grooves by the predetermined angle with respect to the axis of said spindle;

a plurality of resilient locking units mounted respectively in said mounting holes in said clutch portion, each of said locking units including:

a locking pin having an inner end disposed at said inner hole end of the respective one of said mounting holes, and an outer end opposite to said inner end and disposed proximate to said outer hole end of the respective one of said mounting holes, a ball member disposed at said outer hole end of the respective one of said mounting holes adjacent to said outer end of said locking pin, and a compression spring disposed within the respective one of said mounting holes and sleeved around said locking pin for biasing said locking pin in a radial outward direction, said locking units being normally disposed in a first position, in which said ball members of said locking units project radially and outwardly relative to said outer surface of said clutch portion and engage respectively said second locking grooves in said stationary seat for locking said rotary seat to said stationary seat, and in which said inner ends of said locking pins are retracted into said mounting holes and are disengaged from said first locking grooves in said spindle coupling ring for unlocking said rotary seat from said spindle coupling ring, said rotary knob being operable to rotate said spindle for moving said deadbolt between said locking and unlocking positions when said locking units are disposed in the first position;

an electric driving motor having a transmission shaft coupled to said transmission teeth of said rotary seat, said electric driving motor being operable to drive rotation of said rotary seat for moving said locking units to a second position, in which said ball members move rollingly out of said second locking grooves and move along said inner peripheral surface of said stationary seat so as to depress said locking pins in radial directions against restoring action of said compression springs and so as to enable said inner ends of said locking pins to project from said inner surface of said clutch portion and engage respectively said first locking grooves in said spindle coupling ring for locking said rotary seat to said spindle coupling ring, thereby enabling co-rotation of said spindle with said rotary seat for moving said deadbolt between said locking and unlocking positions;

an electric switch unit mounted in said lock housing and connected electrically to said electric driving motor; and a switch actuator mounted on said spindle for co-rotation therewith, said switch actuator projecting in a radial direction with respect to the axis of said spindle, said switch actuator being movable with said spindle relative to said electric switch unit and enabling said electric switch unit to control operation of said electric driving motor in a manner that said electric driving motor drives rotation of said spindle by the predetermined angle when said electric driving motor is operated.

2. The electric door lock as claimed in claim 1, wherein said electric switch unit includes a locking switch and an unlocking switch which are mounted in said lock housing and which are angularly displaced from each other with respect to the axis of said spindle, said switch actuator being disposed proximate to said locking switch when said spindle is rotated to move said deadbolt to the locking position, said switch actuator being disposed proximate to said unlocking switch when said spindle is rotated to move said deadbolt to the unlocking position.

3. The electric door lock as claimed in claim 1, wherein each of said second locking grooves of said stationary seat is defined by a groove-defining wall that has two side wall parts opposing each other, said ball member of each of said locking units moving rollingly past one of said side wall parts of said groove-defining wall of a corresponding one of said second locking grooves when said rotary seat is rotated.

4. The electric door lock as claimed in claim 3, wherein each of said side wall parts has a convex surface confronting said ball member of a respective one of said locking pins.

5. The electric door lock as claimed in claim 1, wherein said locking pin of each of said locking units has a head portion at said outer end, said head portion being formed with a ball recess for receiving said ball member such that said ball member is rotatable within said ball recess.

6. The electrical door lock as claimed in claim 5, wherein said ball recess is hemispherical in shape, said ball member of each of said locking units having a hemispherical part received in said ball recess.

7. The electrical door lock as claimed in claim 1, wherein each of said second locking grooves has a depth smaller than a radius of said ball members.

8. The electric door lock as claimed in claim 1, wherein said locking pin of each of said locking units has a head portion at said outer end, each of said mounting holes including a wider hole section adjacent to said outer hole end, a narrower hole section adjacent to said inner hole end, and a shoulder defined between said wider and narrower hole sections, said compression spring of each of said locking units being disposed in said wider hole section of the respective one of said mounting holes and between said shoulder and said head portion of said locking pin.

9. The electric door lock as claimed in claim 1, wherein each of said mounting holes extends in a radial direction through said clutch portion of said rotary seat.

* * * * *